US005329662A

United States Patent [19]

Salecker

[11] Patent Number: 5,329,662

[45] Date of Patent: Jul. 19, 1994

[54] MANIPULATOR FOR CONDUIT CLEANER

[75] Inventor: Roy W. Salecker, Mendota, Ill.

[73] Assignee: Spartan Tool Div. of Pettibone Corp., Mendota, Ill.

[21] Appl. No.: 47,582

[22] Filed: Apr. 13, 1993

[51] Int. Cl.[5] ..... B08B 9/04; B08B 13/00

[52] U.S. Cl. ..... 15/104.31; 15/104.12; 15/257.01; 294/19.1

[58] Field of Search ..... 15/104.12, 104.31, 104.33, 15/246, 257.01; 294/19.1

[56] References Cited

U.S. PATENT DOCUMENTS

| | | | |
|---|---|---|---|
| 256,611 | 4/1882 | Askew | 294/19.1 |
| 806,019 | 11/1905 | Sullivan et al. | 294/19.1 |
| 3,444,578 | 5/1969 | Caperton | 15/104.31 |
| 4,476,603 | 10/1984 | Lukaszewicz | 15/104.31 |
| 4,516,286 | 5/1985 | Crane | 15/104.31 |
| 4,974,280 | 12/1990 | Ward | 15/257.01 |

*Primary Examiner*—Edward L. Roberts

*Attorney, Agent, or Firm*—Wood, Phillips, VanSanten, Hoffman & Ertel

[57] ABSTRACT

The combination of a fluid operated cleaner, to be directed into a conduit to remove obstructions in a passageway defined by the conduit, and a manipulator. The conduit cleaner has a frame which has a connector for a fluid supply conduit. The manipulator is connected to the conduit so that the manipulator and fluid supply conduit can be used together to reposition the conduit cleaner at a location remote therefrom. Between the manipulator and the fluid supply line, the user is given substantial flexibility in reorienting the conduit cleaner to allow it to be introduced to the entryway of a remotely located conduit.

16 Claims, 2 Drawing Sheets

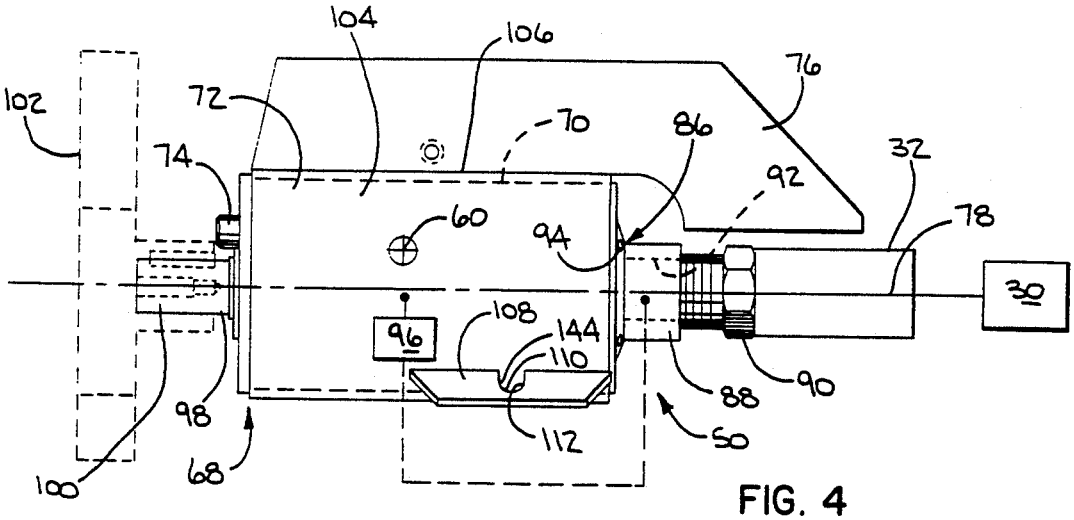
FIG. 4
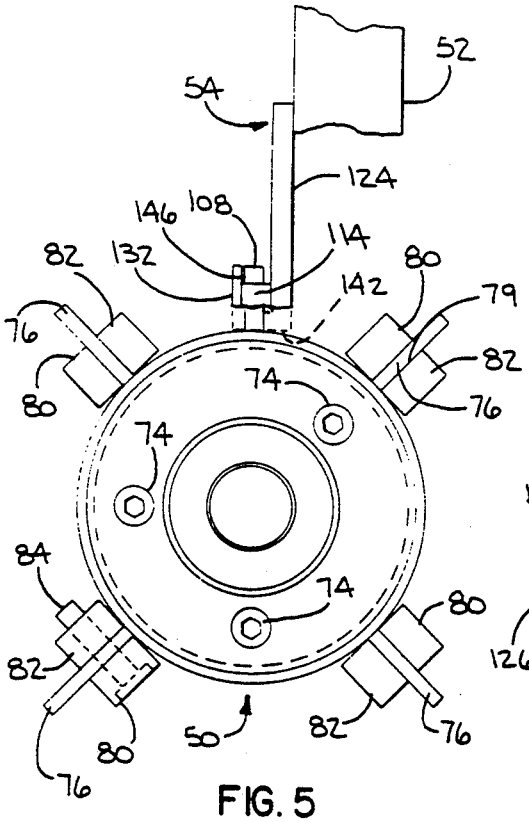
FIG. 5
FIG. 6
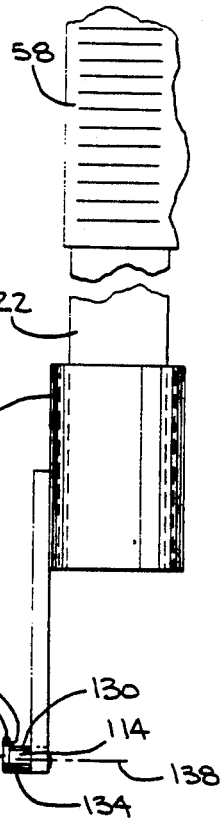
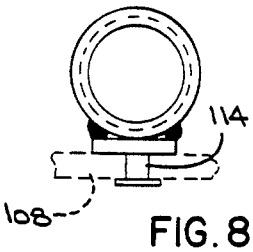
FIG. 8
FIG. 7
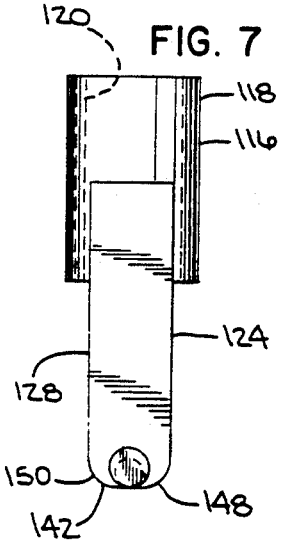

MANIPULATOR FOR CONDUIT CLEANER

BACKGROUND OF THE INVENTION

1. Field of the Invention

This invention relates to conduit cleaners, such as those used to grind/break up foreign matter within, or flush the surface of, a conduit and, more particularly, to a manipulator for the conduit cleaner that facilitates direction of the conduit cleaner into the entryway of a conduit remote from the user thereof.

2. Background Art

Conduit cleaners are well known in the art. In U.S. Pat. No. 3,740,785, to Latall, one such unit is described in detail. This unit has been very commercially successful.

Briefly, the Latall unit has a motor that is operable through a pressurized fluid. Fluid under pressure is directed to the motor to effect operation thereof and to a plurality of jets which cause discharge of the fluid in a trailing direction, which both affords propulsion to the unit and scours the inside of a conduit passageway. The motor drives a rotary blade at the front of the unit which grinds foreign matter within the conduit. A skid assembly facilitates guided movement of the unit within a conduit.

These units are typically used to route sewer lines. In one typical application, a large, vertically extending sewer shaft communicates with a horizontally extending conduit. The sewer shaft may be accessible through a ground level entryway that is closed by a man hole cover, with the entryway to the horizontally extending conduit being many feet below the main sewer opening. Typically, a unit, such as that in U.S. Pat. No. 3,740,785, must be directed through the horizontal conduit. Since the horizontal conduit is not within the reach of a user above ground through the main sewer opening, several different techniques have been employed in the past to introduce the conduit cleaner to the horizontal conduit.

In a first method, the user effects the introduction solely by manipulating a fluid supply conduit that is operatively connected to the conduit cleaner. The supply line is normally flexible but has sufficient rigidity to allow the user to effect reorientation of the conduit cleaner. Typically, the user will blindly lower the conduit cleaner through the supply line into the sewer opening into alignment with the entryway for the horizontal conduit by feeding an amount of the supply conduit out roughly corresponding to the depth of the horizontal conduit. After proper alignment is achieved, the user swings the supply line back and forth in hopes that the conduit cleaner will find its way into the horizontal conduit entryway. Since the entryway to the horizontal conduit is normally not visible from overhead, this operation usually involves trial and error.

Alternatively, the user may be required to feel out the entryway by dragging the conduit cleaner up and down against the wall of the sewer shaft. Both of the above procedures are often frustrating and time consuming endeavors.

One alternative method of introducing the conduit cleaner to the horizontal conduit requires that the user physically move down the sewer shaft into close proximity to the horizontal entryway. In this position, the user can positively feed the conduit cleaner into the horizontal conduit. While this procedure is the most reliable known to date, once the user is required to actually enter the sewer opening, the element of danger is introduced. The user is prone to injury unless the procedure is carefully and properly carried out.

In spite of the drawbacks with the prior art equipment and procedures to date, no alternative exists to those described above for introducing a conduit cleaner into a horizontal conduit remote from a user.

SUMMARY OF THE INVENTION

The present invention is specifically directed to overcoming the above enumerated problems in a novel and simple manner.

In one form, the invention contemplates the combination of a fluid operated cleaner, to be directed into a conduit to remove obstructions in a passageway defined by the conduit, and a manipulator.

The conduit cleaner has a frame which has a connector for a fluid supply conduit. The manipulator is connected to the conduit cleaner so that the manipulator and fluid supply conduit can be used together to reposition the conduit cleaner at a location remote therefrom. Between the manipulator and the fluid supply line, the user is given substantial flexibility in reorienting the conduit cleaner to allow it to be introduced to the entryway of a remotely located conduit.

In one form, the manipulator has a rigid, elongate body, and is connected to the frame so as to be pivotable relative thereto. A supply line can then be used to controllably pivot the conduit cleaner that can be held at a fixed height through the rigid manipulator.

In another form of the invention, a conduit cleaner with a frame and a manipulator are provided, with the manipulator having a first part that is connected to the conduit cleaner frame to allow the first part of the manipulator to be selectively connected to and disconnected from the conduit cleaner frame. With this arrangement, the manipulator can be used only so long as necessary to present the conduit cleaner at the conduit entryway, whereupon the manipulator can be separated from the conduit cleaner so that the manipulator does not obstruct the movement of the conduit cleaner through a conduit.

In one form, the manipulator is connected to the frame through a cooperating projection and receptacle. The receptacle is provided on one of the frame and first part of the manipulator and the projection on the other of the frame and first part of the manipulator. The projection is extendable into and removable from the receptacle with the first part of the manipulator and frame in a first relative position and is blocked in the receptacle with the first part of the manipulator and frame in a second relative position.

In one form, the first part of the manipulator and frame are movable between their first and second positions by relative movement in substantially a straight line.

In one form, the projection is a pin having a body with an axis and an enlarged head on the body. The head has a non-uniform radial projection from the axis of the pin body about its circumference.

In one form, the receptacle is on the frame, which has a peripheral wall with an outer surface to which a plate is attached. The plate has an opening therein which is bounded in part by the outer surface of the frame so as to define the receptacle. The pin body has an outer surface and a head with a portion that is flush in the radial direction with the outer surface of the pin body. With this arrangement, the pin can be moved in a first direction relative to the frame to abut the head portion to the frame outer surface, whereupon movement of the pin transversely to the first direction seats the pin in the frame receptacle in a transition position for the manipulator. Subsequent movement of the pin relative to the frame oppositely to the first direction urges the pin against the frame plate to a carrying position for the manipulator.

The head on the pin defines a first shoulder that faces axially with respect to the pin body, and with the manipulator in the carrying position therefor, the first shoulder abuts to the plate to prevent withdrawal of the pin from the receptacle.

In one form, the conduit cleaner has an axis and axially spaced ends. The first manipulator part is connected to the frame at a location spaced axially away from the center of gravity for the conduit cleaner. With a pivot connection between the manipulator and frame, the conduit cleaner normally tilts under its own weight relative to the first manipulator part. The user can use the supply line or a second manipulator to control this pivoting to situate the conduit cleaner in a desired orientation.

In one form, the first part of the manipulator has a J-shaped fitting with a base and an upturned free end. The upturned free end and base can be directed into the receptacle with the first part of the manipulator and frame in a first relative position. By drawing up on the manipulator with the fitting projected into the receptacle, the base of the J-shaped fitting is borne against the frame with the manipulator in its carrying position. The upturned end of the J-shaped fitting blocks removal of the J-shaped fitting from the receptacle with the manipulator in the carrying position.

The manipulator may have a grip to be grasped by a user at a location remote from the first part of the manipulator to facilitate control of the conduit cleaner.

In one form, the manipulator has an end fitting to be connected to the frame of the conduit cleaner, which end fitting is configured to also be removably connected to an elongate element. By attaching different elongate elements to the end fitting, the overall length and shape of the manipulator can be selected.

The invention further contemplates a method of introducing a conduit cleaner to the entryway of a horizontally extending conduit, which method includes the steps of providing a conduit cleaner having a frame, providing a manipulator with a free end that is other than a supply line to the conduit cleaner, connecting the free end of the manipulator to the frame of the conduit cleaner, and using the manipulator to direct the conduit cleaner into the entryway of a conduit.

A separate fluid supply conduit can be connected to the conduit cleaner. Both the fluid supply conduit and manipulator can then be used independently and cooperatively to direct the conduit cleaner into the conduit.

The invention contemplates that the manipulator can be left intact on the conduit cleaner as the cleaning procedure is carried out or that it be separated from the conduit cleaner so as not to interfere with the cleaning operation.

With the connection between the free end of the manipulator and the frame being a pivot connection, the invention contemplates the step of using the supply line to pivot the conduit cleaner about an axis that is transverse to the length of the conduit into which the conduit cleaner is directed.

BRIEF DESCRIPTION OF THE DRAWINGS

FIG. 4 is a side elevation view of the conduit cleaner according to the present invention;

FIG. 5 is a front elevation view of the conduit cleaner in FIG. 4 with a manipulator, according to the present invention, operatively attached thereto;

FIG. 6 is an end elevation view of the inventive manipulator;

FIG. 7 is a side elevation view of an end fitting on the inventive manipulator; and FIG. 8 is a plan view of the end fitting of FIG. 7.

DETAILED DESCRIPTION OF THE DRAWINGS

Figure 1:
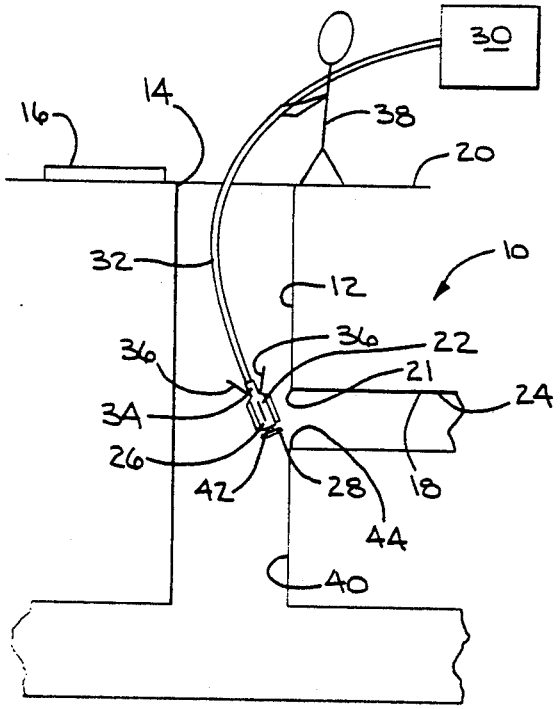
FIG. 1 (PRIOR ART)
FIG. 1 is a schematic representation of a prior art conduit cleaner being introduced through a vertical sewer shaft into a horizontally extending conduit.

In FIG. 1, a sewer system is shown schematically at 10 to be representative of one environment in which the present invention is particularly useful. It should be understood that the inventive structure could be used in other environments to, for example, access remote, vertically extending conduits through a horizontal conduit.

The system 10 includes a vertically extending sewer shaft 12 with a ground level entryway 14 that is normally closed by a conventional man hole cover 16. Spaced vertically downwardly from the entryway 14 is a horizontally extending conduit 18 in communication with the sewer opening 12. The conduit 18 is located sufficiently below ground level 20 that it is impossible for the operator to reach down from ground level and access the entryway 22 to the conduit 18, as to introduce the conduit cleaner 22.

Typically, the conduit cleaner 22 is introduced to the conduit 18 to break up foreign matter, such as a root formation, solid sewage, or to merely scour the walls 24, as to break loose a fat or paraffin buildup.

The conduit cleaner 22 can take a wide variety of different forms. The precise form is unimportant to the present invention, which is adaptable to virtually all known conduit cleaners 22. A suitable conduit cleaner 22, that is known in the prior art, is described in detail in U.S. Pat. No. 3,740,785, to Latall, which is incorporated herein by reference.

It suffices to say that the conduit cleaner 22 has a motor 26 that operates to rotate a cutting blade 28. Pressurized fluid from a supply 30 is delivered via a flexible conduit 32 to a nozzle section 34 which controllably delivers the pressurized fluid to the motor 26 for operation thereof and additionally communicates fluid to a plurality of ports (not shown) which cause discharge in a trailing spray pattern 36 which propels the conduit cleaner 22 and also effects scouring of the conduit wall within which the conduit cleaner 22 resides.

To direct the conduit cleaner into the conduit 18, the user 38, located above ground, positions him or herself at the entryway 14 and feeds the conduit 32 into the sewer opening 12. The normally coiled conduit 32 has some shape memory and may maintain a slightly bowed configuration, as shown in FIG. 1, even under the weight of the conduit cleaner 22. The conduit cleaner assumes a slightly tipped orientation, as shown in FIG. 1, and in that position can be dragged vertically along the wall 40 bounding the sewer shaft 12. By dragging the conduit cleaner 22 down the wall 40, the user attempts to sense the entryway 23. Once the dragging is interrupted at the entryway 23, the user can jiggle and reposition the conduit 32 to try to funnel the leading end 42 of the conduit cleaner into the conduit 24. There is, however, a tendency of the conduit cleaner 22 to hang up on the edge 44 at the juncture between the conduit wall 24 and shaft wall 40.

Alternatively, the user can gauge the distance between ground level 20 and the horizontal conduit 18 and feed a corresponding amount of the conduit 32 into the shaft 12. By manipulating the conduit 32, the user can then swing the conduit cleaner 22 back and forth in a horizontal direction in hopes that the conduit cleaner 22 will find its way into the conduit 18.

As can be seen, both of these methods involve much trial and error. It is often by mere chance that the conduit cleaner 22 finds its way into the conduit 18. In the meantime, valuable time is expended in attempting to carry out this operation.

In some environments, the above procedures may be so difficult to carry out that the user may be required to physically move down the shaft 12 to place the conduit cleaner 22 directly into the conduit 24. This is obviously inconvenient for the user and introduces the element of danger into the operation.

Figure 3:
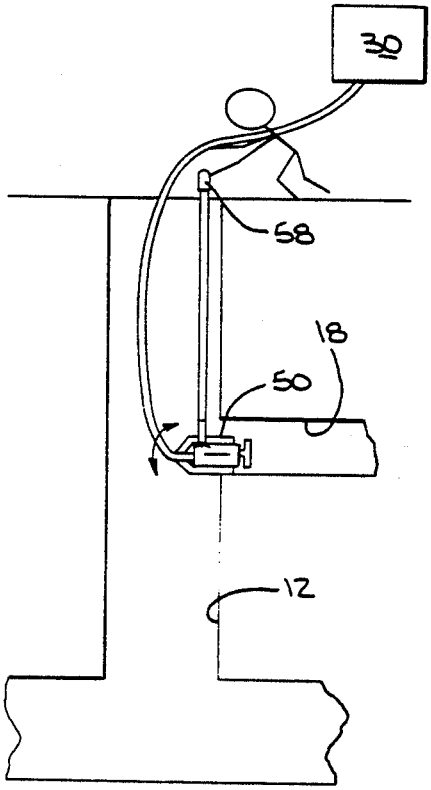
FIG. 3 is a view as in FIG. 2 with the conduit cleaner successfully introduced to the entryway of the horizontal conduit.
Figure 2:
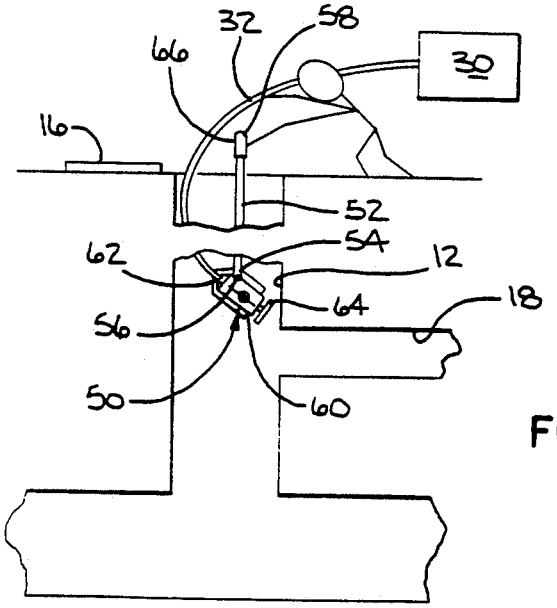
FIG. 2 is a view corresponding to that of FIG. 1 wherein a conduit cleaner, according to the present invention, is in the process of being introduced to the horizontal conduit using a manipulator according to the present invention.

FIGS. 2 and 3 show a sequence of steps used to introduce a conduit cleaner 50, according to the invention, into the conduit 18 through the sewer shaft 12. The details of construction of the conduit cleaner 50 are described with respect to FIGS. 4 and 5 below. As previously indicated, the precise configuration of the conduit cleaner 50 is not critical to the invention. The conduit cleaner 50 disclosed is the subject of other copending patent applications.

According to the invention, a manipulator 52 has an end 54 that is connected to the conduit cleaner 50 so as to be movable relative thereto. Details of this connection will be described below and it suffices to say that in one form this connection is a pivotable connection for relative movement between the conduit cleaner 50 and manipulator 52 about a horizontal axis 56. The control portion/end 58 of the manipulator 52 remote from the end 54 is graspable by the user to control the elevation of the conduit cleaner 50. In a preferred form, tho manipulator end 54 is connected to the conduit cleaner 50 at a location offset from the center of gravity 60 for the conduit cleaner 50 so that the conduit cleaner 50, under its own weight, tilts about the axis 56, as shown in FIG. 2. Preferably, the connection of the manipulator end 54 is effected at a location spaced from the center of gravity 60 towards the trailing end 62 of the conduit cleaner 50 so that the forward/leading end 64 of the conduit cleaner 50 tips downwardly.

At the start of the operation, the user connects both the supply conduit 32 and the manipulator 52 to the conduit cleaner 50. The user grasps a grip 66 at the manipulator end 58 and lowers the conduit cleaner 50 down the shaft 12 while maintaining the conduit cleaner 50 in the slightly tipped orientation of FIG. 2. The leading end 64 of the conduit cleaner can then be used to sense when the conduit cleaner 50 is in vertical coincidence with the conduit 18. Once the conduit cleaner 50 is in vertical coincidence with the conduit 18, the user can press down on the supply conduit 32 to tip the conduit cleaner to a horizontal orientation, as shown in FIG. 3. At the same time, the user exerts a horizontal force on the manipulator to drive the conduit cleaner 50 into the conduit 18. Once the manipulator 52 is draw inwardly to the point that it abuts to the wall 40, the manipulator 52 is released by structure described hereafter. At this point, the center of gravity for the conduit cleaner 50 resides within the conduit 18 so that the conduit cleaner 50 is not prone to falling out of the conduit 18 and down the sewer shaft 12. As can be seen, a convenient structure is afforded to allow quick and consistent introduction of the conduit cleaner 50 into a remote conduit, such as the horizontal conduit 18.

The details of structures that allow the aforementioned method to be carried out are shown in FIGS. 4 through 8. In FIGS. 4 and 5, the conduit cleaner 50 is shown to include a power unit 68 consisting of a motor 70 contained within a cylindrical frame 72 and suitably secured thereto, as by bolts 74. The frame 72 includes four circumferentially spaced, elongate skids 76 which extend generally parallel to the axis 78 of the conduit cleaner 50. The skids 76 cooperatively guide the conduit cleaner 50 within the conduit, such as the conduit 18. The skids 76 reside, one each, within spaces 79 defined between four pairs of mounting plates 80, 82. The connection of each skid 76 to the mounting plates 80, 82 is maintained by a pin 84.

A nozzle 86 is provided at the trailing end of the conduit cleaner 50 and has a fitting 88 thereon to threadably accept a connector 90 on the end of supply conduit 32.

Fluid from the supply 30 flows through the conduit 32 and into a pressure chamber 92 defined within the nozzle 86. The pressure chamber 92 communicates with a plurality of circumferentially spaced jets 94, which direct fluid radially outwardly and in a trailing direction to propel the conduit cleaner 50 and scour a conduit within which the conduit cleaner 50 resides.

Through an appropriate means 96, the fluid from the pressure chamber 92 is simultaneously communicated to the motor 70. The motor 70 has a shaft 98 which rotates about the axis 78. The shaft has a forward projection 100 to which a rotary cutting blade 102 is attached.

The frame 72 has a body 104 with a cylindrical outer surface 106. A plate 108 is welded to the frame outer surface 106. The frame plate 108 has a U-shaped cutout 110 defining a closed receptacle 112, bounded in part by the outer surface 106 of the frame body 104.

The receptacle 112 is configured to accommodate a projection/pin 114 at the end 54 of the manipulator 52. The pin 114 is carried on an end fitting 116 on the manipulator 52. The end fitting 116 has a cylindrical body 118 with a threaded blind bore 120 to accept an elongate, straight or curved, rigid pole 122. A rectangular stem 124 is welded to the outer surface 126 of the end fitting body 118 to define an end 128 that projects therefrom in cantilever fashion. The stem 124 is preferably made from an rectangular piece of flat material. The pin 114 is secured to the stem 124 in suitable fashion, as by welding, threaded connection, etc.

The pin 114 has a cylindrical body 130 and an enlarged head 132 at the free end of the body 130. The lower portion of the head 132 is flush with and conforms to the outer surface 134 of the pin body 114. The upper end 136 of the head 132 projects radially upwardly relative to the axis 138 of the body 130 so as to define a shoulder 140 facing axially relative to the pin body 130.

The pin 114 and receptacle 112 on the plate 108 are relatively dimensioned so that with the lowermost edge 142 of the stem 124 abutted to the outer surface 106 of the frame body 104, the pin 114 can be directed in an axial direction through the receptacle 112 to fully expose the head 132, which represents the transition position, shown in phantom lines in FIG. 5. By drawing upwardly on the manipulator 52, the outer surface 134 of the pin body 130 bears against the curved surface 144 of the frame plate 108 bounding the cutout 110. This represents the carrying position for the manipulator 52. In the carrying position 52, the shoulder 140 on the pin head 132 abuts to the plate surface 146 to prevent withdrawal of the pin 114 from the receptacle 112. The pin 114 and stem 124 cooperatively produce a J-shape which acts as a hanger for the conduit cleaner 50 to allow it to be lowered conveniently into the sewer shaft 12. At the same time, the conduit cleaner 50 is allowed to pivot about the axis 138 of the pin 114 which allows the reorientation described with respect to FIGS. 2 and 3 herein. The pivoting can be controlled by the supply conduit 32, as previously described, and/or by strategically shaping the lower comers 148, 150 of the stem 124 to abut the outer surface 106 of the body 104 to limit relative pivoting in both directions.

To release the manipulator 52, the user need only press down on the manipulator 52 with the conduit cleaner 50 supported. This takes the pin shoulder 140 out of confronting relationship with the plate surface 146 and allows the pin 114 to be withdrawn from the receptacle 112.

A flexible manipulator 52 could also be used which may not have to be disconnected by the user.

It can be seen that the user can quickly and conveniently connect the manipulator 52 to the conduit cleaner 50. Lowering and reorientation of the conduit cleaner 50 is thus facilitated. Disconnection of the manipulator 52 can be simply accomplished by two simple movements thereof.

The invention allows the user to conveniently introduce the conduit cleaner 50 into a conduit 18 without trial and error and without having to physically move into, for example, a sewer shaft 12.

The foregoing disclosure of specific embodiments is intended to be illustrative of the broad concepts comprehended by the invention.

I claim:

1. In combination:

a cleaner to be directed into a conduit to remove obstructions in a passageway defined by a conduit, said conduit cleaner including a frame;

a manipulator having an elongate body with a lengthwise axis; and means cooperating between a first part of the manipulator and the conduit cleaner frame to a) allow the first part of the manipulator to be selectively connected to and disconnected from the conduit cleaner frame by movement of the first manipulator part relative to the conduit cleaner frame in a first line substantially perpendicular to the lengthwise axis of the elongate manipulator body with the first manipulator part and conduit cleaner frame in a first relative position along the lengthwise axis of the manipulator body and b) prevent the first manipulator part from being disconnected from the conduit cleaner frame by movement of the first manipulator part in the first line with the first manipulator part and conduit cleaner frame in a second relative position along the lengthwise axis of the manipulator body, said manipulator including a control portion that can be engaged by an operator and repositioned to controllably move the conduit cleaner to facilitate its direction into a conduit entryway that is not within direct reach of an operator, whereby a user can use the manipulator to direct the conduit cleaner into a conduit entryway remote from a user and thereafter release the manipulator from the conduit cleaner.

2. The combination according to claim 1 wherein the conduit cleaner has an axis, axially spaced ends and a center of gravity and the first manipulator part is connected to the frame at a location spaced axially away from the center of gravity for the conduit cleaner.

3. The combination according to claim 1 wherein the manipulator has a grip to be grasped by a user at a location remote from the first part of the manipulator.

4. The combination according to claim 1 wherein the manipulator has an end fitting to be connected to the frame of the conduit cleaner, said end fitting including means for removably connecting the end fitting to an elongate element, whereupon by attaching different elongate elements to the end fitting, the overall length and shape of the manipulator can be selected.

5. The combination according to claim 1 wherein the conduit cleaner is operable by a fluid under pressure.

6. The combination according to claim 5 including a fluid supply conduit and means for connecting the fluid supply conduit to the conduit cleaner independently of the manipulator, whereby a user can use both the fluid supply conduit and manipulator to reposition the conduit cleaner from a location remote from the conduit cleaner.

7. In combination:

a cleaner to be directed into a conduit to remove obstructions in a passageway defined by a conduit, said conduit cleaner including a frame;

a manipulator; and means cooperating between a first part of the manipulator and the conduit cleaner frame to allow the first part of the manipulator to be selectively connected to and disconnected from the conduit cleaner frame, said manipulator including a control portion that can be engaged by an operator and repositioned to controllably move the conduit cleaner to facilitate its direction into a conduit entryway that is not within direct reach of an operator, whereby a user can use the manipulator to direct the conduit cleaner into a conduit entryway remote from a user and thereafter release the manipulator from the conduit cleaner, wherein the cooperating means includes a receptacle on one of the frame and the first part of the manipulator and a projection on the other of the frame and the first part of the manipulator, said projection a) being extendable into and removable from the receptacle with the first part of the manipulator and frame in a first relative position and b) being blocked in the receptacle with the first part of the manipulator and frame in a second relative position.

8. The combination according to claim 7 wherein the first part of the manipulator and frame are relatively movable between the first and second positions by relative movement in substantially a straight line.

9. The combination according to claim 7 wherein the projection comprises a pin having a body with an axis and an enlarged head on the body and the head has a non-uniform radial projection from the axis of the pin body.

10. The combination according to claim 9 wherein the receptacle is on the frame, said frame peripheral wall having an outer surface to which a plate is attached, said plate having an opening therein which is bounded in part by the outer surface of the frame so as to define the receptacle and the pin body has an outer surface and the head has a portion that is flush in a radial direction with the outer surface of the pin body, whereby the pin can move in a first direction to abut the head portion to the frame outer surface whereupon movement of the pin transversely to the first direction seats the pin in the receptacle in a transition position for the manipulator and thereupon movement of the pin relative to the frame oppositely to the first direction urges the pin against the frame plate in a carrying position for the manipulator.

11. The combination according to claim 10 Wherein the head on the pin has a first shoulder that faces axially with respect to the pin body and with the manipulator in its carrying position the first shoulder abuts to the plate to prevent withdrawal of the pin from the receptacle.

12. The combination according to claim 7 wherein the frame has a surface bounding the receptacle and the projection has a body with an outer surface that is abuttable to the frame surface bounding the receptacle and at least one of the frame surface bounding the receptacle and outer surface on the body of the projection is curved to allow the conduit cleaner to pivot relative to the manipulator.

13. In combination:

a cleaner to be directed into a conduit to remove obstructions in a passageway defined by a conduit.

said conduit cleaner including a frame;

a manipulator; and means cooperating between a first part of the manipulator and the conduit cleaner frame to allow the first part of the manipulator to be selectively connected to and disconnected from the conduit cleaner frame, said manipulator including a control portion that can be engaged by an operator and repositioned to controllably move the conduit cleaner to facilitate its direction into a conduit entryway that is not within direct reach of an operator, whereby a user can use the manipulator to direct the conduit cleaner into a conduit entryway remote from a user and thereafter release the manipulator from the conduit cleaner, wherein the cooperating means on one of the first part of the manipulator and frame comprises a J-shaped fitting with a base and an upturned free end, the cooperating means on the other of the first pan of the manipulator and frame comprises a receptacle defined by a frame opening and the base and upturned free end on the J-shaped fitting can be directed into the receptacle with the first part of the manipulator and frame in a first relative position and whereupon drawing up on the manipulator bears the base of the J-shaped fitting against the frame with the manipulator in a carrying position, said upturned end of the J-shaped fitting blocking removal of the J-shaped fitting from the receptacle with the manipulator in the carrying position.

14. In combination:

a fluid operated cleaner to be directed into a conduit to remove obstructions in a passageway defined by a conduit, said conduit cleaner including a frame and having a lengthwise axis;

means on the fame for connection to a fluid supply conduit;

an elongate manipulator having a lengthwise axis; and means cooperating between the conduit cleaner frame and manipulator for connecting the manipulator to the conduit cleaner frame so that a) the manipulator and fluid supply conduit can be used to reposition the conduit cleaner at a location remote therefrom to facilitate introduction of the conduit cleaner as into a horizontally directed conduit and b) the relative positions of the lengthwise axes of the conduit cleaner frame and manipulator can be changed with the manipulator connected to the conduit cleaner frame.

15. The combination according to claim 14 wherein the manipulator has a rigid, elongate body.

16. The combination according to claim 14 wherein the connecting means comprises means for pivotably connecting the manipulator to the frame.

* * * * *